US011248558B2

(12) United States Patent
Ichikawa et al.

(10) Patent No.: US 11,248,558 B2
(45) Date of Patent: Feb. 15, 2022

(54) ENGINE

(71) Applicant: MAZDA MOTOR CORPORATION, Hiroshima (JP)

(72) Inventors: Kazuo Ichikawa, Aki-gun (JP); Yoshihisa Nou, Aki-gun (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 3 days.

(21) Appl. No.: 16/771,581

(22) PCT Filed: Nov. 27, 2018

(86) PCT No.: PCT/JP2018/043533
§ 371 (c)(1),
(2) Date: Jun. 10, 2020

(87) PCT Pub. No.: WO2019/123991
PCT Pub. Date: Jun. 27, 2019

(65) Prior Publication Data

US 2021/0215119 A1 Jul. 15, 2021

(30) Foreign Application Priority Data

Dec. 19, 2017 (JP) ..... JP2017-242756

(51) Int. Cl.
*F02F 7/00* (2006.01)
*F02F 1/24* (2006.01)

(52) U.S. Cl.
CPC ..... *F02F 7/0053* (2013.01); *F02F 7/0007* (2013.01); *F02F 1/24* (2013.01);
(Continued)

(58) Field of Classification Search
CPC ..... F02F 7/0053; F02F 7/0007; F02F 7/0021; F02F 7/0085; F02F 2007/0056; F02F 2007/0063
See application file for complete search history.

(56) References Cited

U.S. PATENT DOCUMENTS 4,446,827 A * 5/1984 Kubozuka ..... F02F 7/0007 123/193.2
4,630,579 A * 12/1986 Atkin ..... F02F 7/0053 123/195 H (Continued)

FOREIGN PATENT DOCUMENTS

JP S57-010438 U 1/1982
JP S58-077140 U 5/1983

(Continued)

OTHER PUBLICATIONS

International Search Report issued in PCT/JP2018/043533; dated Feb. 12, 2019.

(Continued)

*Primary Examiner* — Long T Tran
(74) *Attorney, Agent, or Firm* — Studebaker & Brackett PC

(57) ABSTRACT

An engine includes an output shaft, a cylinder block, a cylinder head, a cap portion, and head bolts. The cylinder block, the cylinder head, and the cap portion are fastened together with the head bolts. The cylinder block includes a cylinder portion and a plurality of output shaft supporting portions. When an outer wall face of at least one of the plurality of output shaft supporting portions is viewed along an output shaft axial direction, the outer wall face includes a first rib diagonally extending from a supporting portion of the output shaft toward one of two head bolt holes.

18 Claims, 7 Drawing Sheets

(52) U.S. Cl.
CPC ..... *F02F 2007/0041* (2013.01); *F02F 2007/0063* (2013.01)

(56) References Cited

U.S. PATENT DOCUMENTS

| | | | | | |
|---|---|---|---|---|---|
| 5,743,230 | A * | 4/1998 | Yamazaki | F01M 1/02 | 123/192.2 |
| 5,901,680 | A * | 5/1999 | Ozeki | F02F 7/0007 | 123/195 R |
| 6,101,994 | A | 8/2000 | Ichikawa | | |
| 6,158,402 | A * | 12/2000 | Taguchi | F02B 75/221 | 123/53.1 |
| 6,886,522 | B1 | 5/2005 | Lawrence | | |
| 9,719,462 | B2 * | 8/2017 | Lavazza | F02F 7/0021 | |
| 2004/0035375 | A1 * | 2/2004 | Gibisch | B22D 19/0009 | 123/41.74 |
| 2005/0076876 | A1 | 4/2005 | Hada et al. | | |
| 2015/0369169 | A1 * | 12/2015 | Barnes | F01L 1/053 | 123/90.17 |

FOREIGN PATENT DOCUMENTS

| | | | |
|---|---|---|---|
| JP | H10-266892 | A | 10/1998 |
| JP | H10-318040 | A | 12/1998 |
| JP | H11-200941 | A | 7/1999 |
| JP | H11-200943 | A | 7/1999 |
| JP | 2005-113888 | A | 4/2005 |
| JP | 2005-163764 | A | 6/2005 |
| JP | 2006-336612 | A | 12/2006 |
| JP | 2007-120359 | A | 5/2007 |

OTHER PUBLICATIONS

An Office Action issued by the German Patent Office dated May 21, 2021, which corresponds to German Patent Application No. 11 2018 005 931.6 and is related to U.S. Appl. No. 16/771,581 with English language translation.

An Office Action mailed by China National Intellectual Property Administration dated Jun. 10, 2021 which corresponds to Chinese Patent Application No. 20188081088.0 and is related to U.S. Appl. No. 16/771,581 with English language summary.

* cited by examiner

ENGINE

TECHNICAL FIELD

The present invention relates to an engine, in particular, an engine in which a cylinder head, a cylinder block, and a cap portion are fastened together.

BACKGROUND ART

In an engine for a vehicle, a cylinder head is mounted on an upper portion of a cylinder block and a cap portion is attached to a lower portion of the cylinder block with an output shaft held between the cylinder block and the cap portion. In a conventional engine, a cylinder block and a cylinder head are fastened with head bolts inserted downward, from a top face side of the cylinder head, in the cylinder head to be screwed in female threads provided in the cylinder block, while the cylinder block and the cap portion are fastened with cap bolts inserted upward, from a bottom face side of the cap portion, in the cap portion to be screwed in female threads provided in the cylinder block.

In recent years, weight reduction of the engine has been required. As a solution for such a requirement, an engine in which a cylinder head, a cylinder block, and a cap portion are fastened together has been developed (Patent Literature 1).

In the engine disclosed in Patent Literature 1, head bolts are inserted, from a top face side of the cylinder head, in the cylinder head and the cylinder block to be screwed in female threads provided in a cap portion to fasten together the cylinder head, the cylinder block, and the cap portion. Fastening together the cylinder head, the cylinder block, and the cap portion can reduce the number of bolts and can reduce the weight of the engine.

CITATION LIST

Patent Literature

Patent Literature 1: JP H11-200943 A

SUMMARY OF INVENTION

In an engine having a structure in which the cylinder head, the cylinder block, and the cap portion are fastened together as disclosed in Patent Literature 1, the cylinder block is held between the cylinder head and the cap portion, and high sealability between the cylinder block and the cylinder head needs to be provided by a compressional stress (stress created by screwing bolts) acting on the cylinder block in a cylinder axial direction. For this reason, such an engine also needs to have a structure having a sufficient strength to endure the compressional stress created by fastening the bolts. However, there is a limit to increasing an area of a mating face between the cylinder block and the cap portion. If the area of the mating face between the cylinder block and the cap portion is increased, the mating face might interfere with a counter weight of an output shaft.

The present invention has been made to solve the problem described above. An object of the present invention is to provide an engine having a structure in which a cylinder head, a cylinder block, and a cap portion are fastened together and having a strength to endure a compressional stress acting on the cylinder block while suppressing an increase in the area of the mating face between the cylinder block and the cap portion.

An engine according to one aspect of the present invention includes an output shaft of the engine, a cylinder block including a cylinder portion in which a cylinder is formed, and a plurality of output shaft supporting portions each having a portion that supports the output shaft at a location closer to the output shaft with respect to the cylinder portion, the cylinder block being disposed in an upper side of the output shaft in a cylinder axial direction, a cylinder head attached to an upper portion of the cylinder block in the cylinder axial direction, cap portions each attached to a lower portion of one of the plurality output shaft supporting portions in the cylinder axial direction and having a portion that supports the output shaft, and head bolts for fastening together the cylinder block, the cylinder head, and the cap portions. The cylinder block has two head bolt holes each provided at a location, in an output shaft axial direction in which the output shaft extends, that corresponds to one of the plurality of output shaft supporting parts and penetrating, in the cylinder axial direction, a portion in a radially outer side of the output shaft as viewed along the output shaft axial direction, the head bolts being inserted in the head bolt holes, and when at least one of the plurality of output shaft supporting portions is viewed along the output shaft axial direction, an outer wall face of the at least one output shaft supporting portion includes a first rib diagonally extending from a supporting portion of the output shaft toward one of the two head bolt holes.

DESCRIPTION OF EMBODIMENTS

Figure 1:
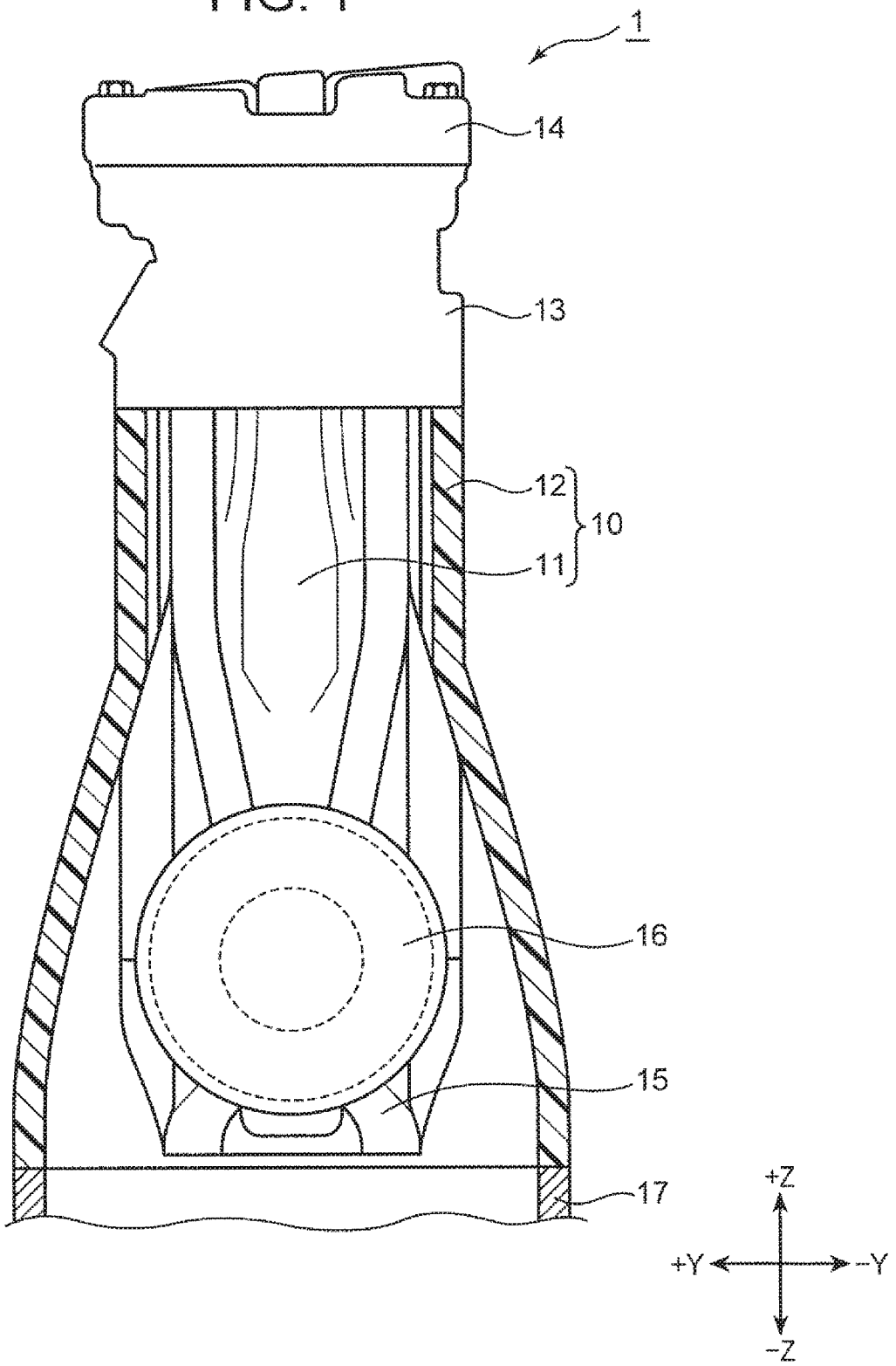
FIG. 1 is a schematic front view (with a partial sectional view) illustrating a schematic configuration of an engine according to an embodiment.

An embodiment of the present invention will be described with reference to the drawings. It should be noted that the embodiment described below is an example of the present invention. The scope of the present invention is not limited to the embodiment described below except for an essential configuration.

In the drawings described below, X direction is an output shaft axial direction, Y direction is an intake and exhaust direction, and Z direction is a cylinder axial direction.

Embodiment

1. General Configuration of Engine 1

A configuration of an engine 1 will be described with reference to FIGS. 1 and 2.

The engine 1 according to the present embodiment is an exemplary four-cylinder gasoline engine. As illustrated in FIG. 1, the engine 1 includes a cylinder block 10, a cylinder head 13, a head cover 14, a bearing cap (cap portion) 15, a crank shaft (output shaft) 16, and an oil pan 17.

The cylinder block 10 includes a block core 11 formed using a metal material, and a cylinder block outer wall 12 formed using a resin material. Details on the block core 11 will be described later.

The cylinder block outer wall 12 surrounds the block core 11, the bearing cap 15, and a portion of the crank shaft 16. The oil pan 17 is joined to a −Z portion of the cylinder block outer wall 12. Although not illustrated in detail in FIG. 1, a water jacket, which is a passage through which a liquid coolant flows, is formed in the cylinder block outer wall 12.

The cylinder head 13 is attached to a +Z portion of the cylinder block 10. Although not illustrated in FIG. 1, the cylinder head 13 includes a cam shaft, an intake and exhaust valve, and an intake and exhaust manifold.

The head cover 14 is attached to a +Z portion of the cylinder head 13 to close a +Z opening of the cylinder head 13.

The bearing cap (cap portion) 15 is attached to a −Z portion of the block core 11. The bearing cap 15 and the block core 11 rotatably support the crank shaft 16.

Figure 2:
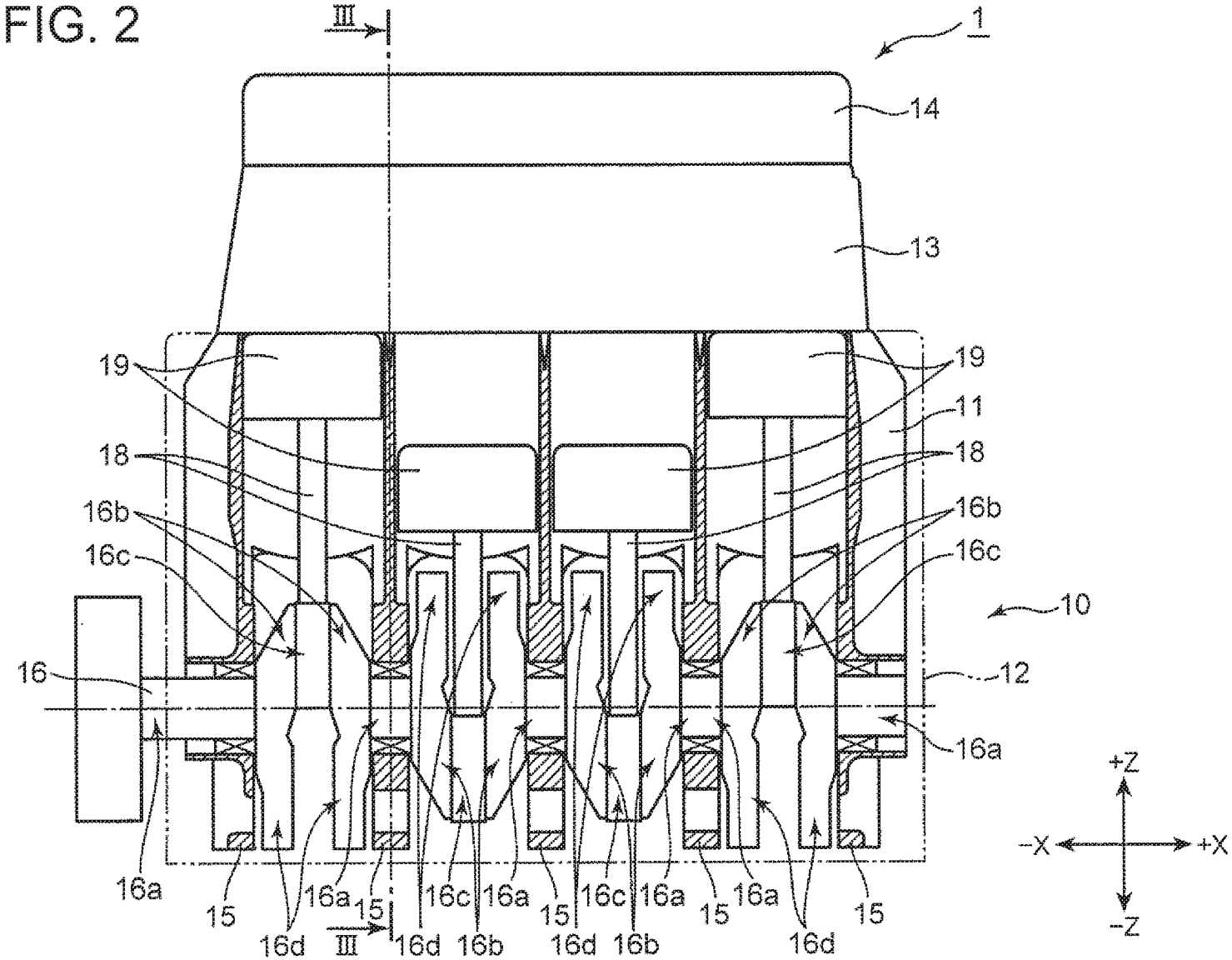
FIG. 2 is a schematic side view illustrating a schematic configuration of the engine.

As illustrated in FIG. 2, the crank shaft 16 extends in X direction. The crank shaft 16 includes crank journals 16*a* supported by the block core 11 and the bearing cap 15, crank arms 16*b* each provided between the crank journals 16*a* adjacent along X direction, crank pins 16*c* each provided between a pair of crank arms 16*b* adjacent along X direction, counter weights 16*d* each continuing from one of the crank arms 16*b*.

A con rod (connecting rod) 18 is rotatably attached to each crank pin 16*c*, and a piston 19 is attached to the other end of the con rod 18. The piston 19 can reciprocate along Z direction inside the cylinder. The crank shaft 16 rotates along with reciprocation of the piston 19.

2. Configuration of Assembly of Cylinder Head 13, Block Core 11, and Bearing Cap 15

Figure 3:
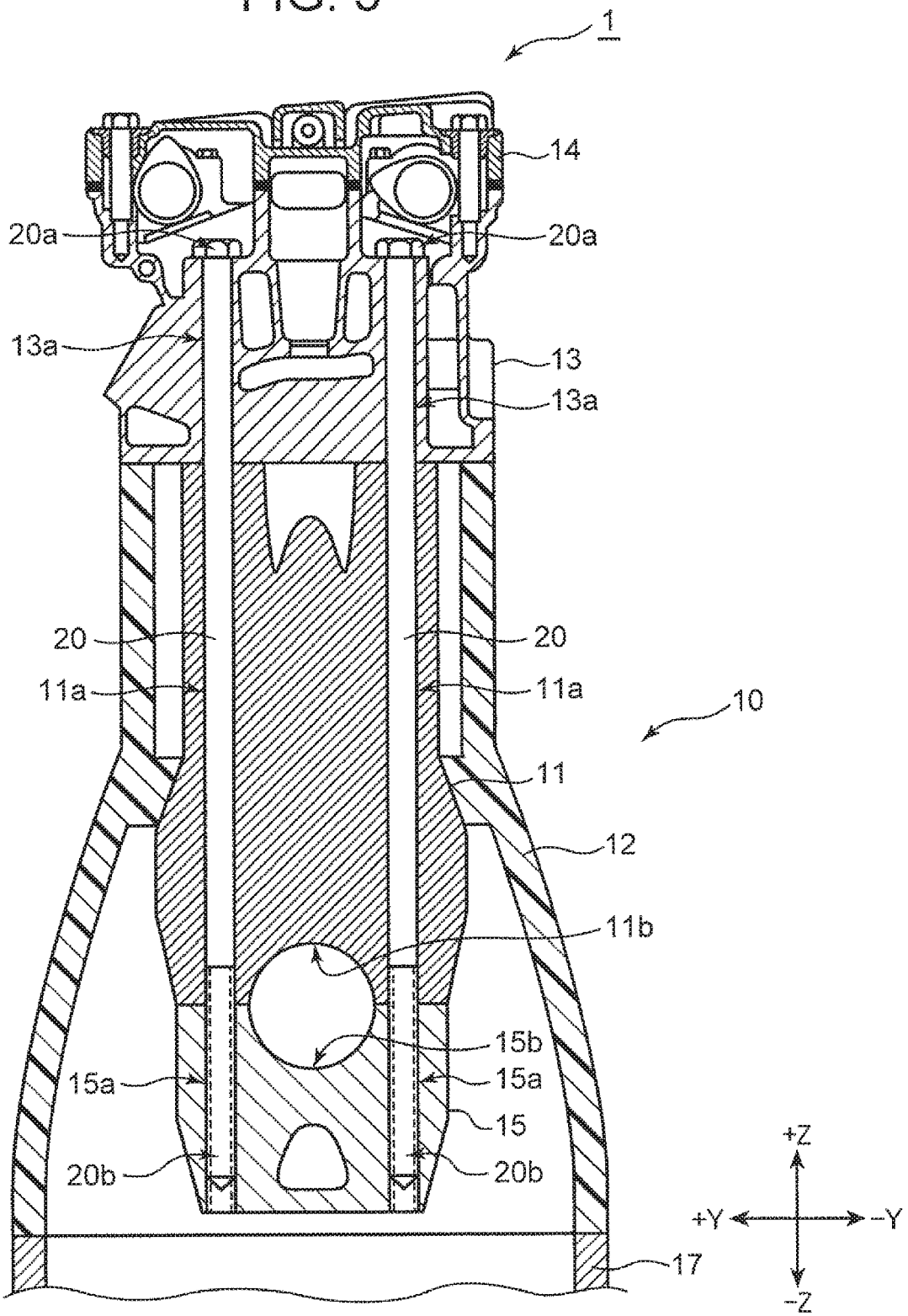
FIG. 3 is a schematic sectional view taken along line III-III in FIG. 2, illustrating a configuration of an assembly of a cylinder head, a block core, and a bearing cap.

A configuration of an assembly of the cylinder head 13, the block core 11, and the bearing cap 15 will be described with reference to FIG. 3. FIG. 3 is a schematic sectional view taken along line III-III in FIG. 2.

As illustrated in FIG. 3, a plurality of head bolt holes 11*a* are provided in the block core 11. A plurality of the head bolt holes 11*a* form pairs of holes, where each of the pairs is provided across Y direction. The head bolt holes 11*a* penetrate the block core 11 in Z direction, and run through portions beyond edges in Y direction (radially outside portions) of a bearing portion 11*b* in which the crank shaft 16 is disposed.

A plurality of head bolt holes 13*a* are provided in the cylinder head 13. A plurality of the head bolt holes 13*a* in the cylinder head 13 each communicates with one of the head bolt holes 11*a* in the block core 11. A plurality of the head bolt holes 13*a* penetrate the cylinder head 13 in Z direction.

The bearing cap 15 includes a plurality of threaded holes 15*a* provided in portions beyond edges in Y direction (radially outside portions) of a bearing portion 15*b* in which the crank shaft 16 is disposed. Each of the threaded holes 15*a* communicates with one of the head bolt holes 11*a* in the block core 11. A plurality of the threaded holes 15*a* penetrate the bearing cap 15 in Z direction.

In the engine 1, a plurality of the head bolts 20 are inserted, from +Z side of the cylinder head 13, in the head bolt hole 13*a* and the head bolt hole 11*a*, and a threaded portion 20*b* provided to each of −Z distal end portions of the head bolts 20 is screwed in a female thread of one of the threaded holes 15*a* in the bearing cap 15.

As illustrated in FIG. 3, in the engine 1 according to the present embodiment, the cylinder head 13, the block core 11, and the bearing cap 15 are fastened together with the head bolts 20. Thus, in the engine 1, the cylinder head 13 and the block core 11 are held between bolt heads 20*a* of the head bolts 20 and screwed portions where the threaded portions 20*b* are screwed in the threaded holes 15*a* in the bearing cap 15. In more detail, the block core 11 is held between the cylinder block 13 and the bearing cap 15 along Z direction.

FIG. 3 illustrates an exemplary section of the engine 1 (section taken along line III-III in FIG. 2). Other fastener portions fastened with the head bolt 20 have a similar configuration.

3. Configuration of Block Core 11 and Bearing Cap 15

Figure 4:
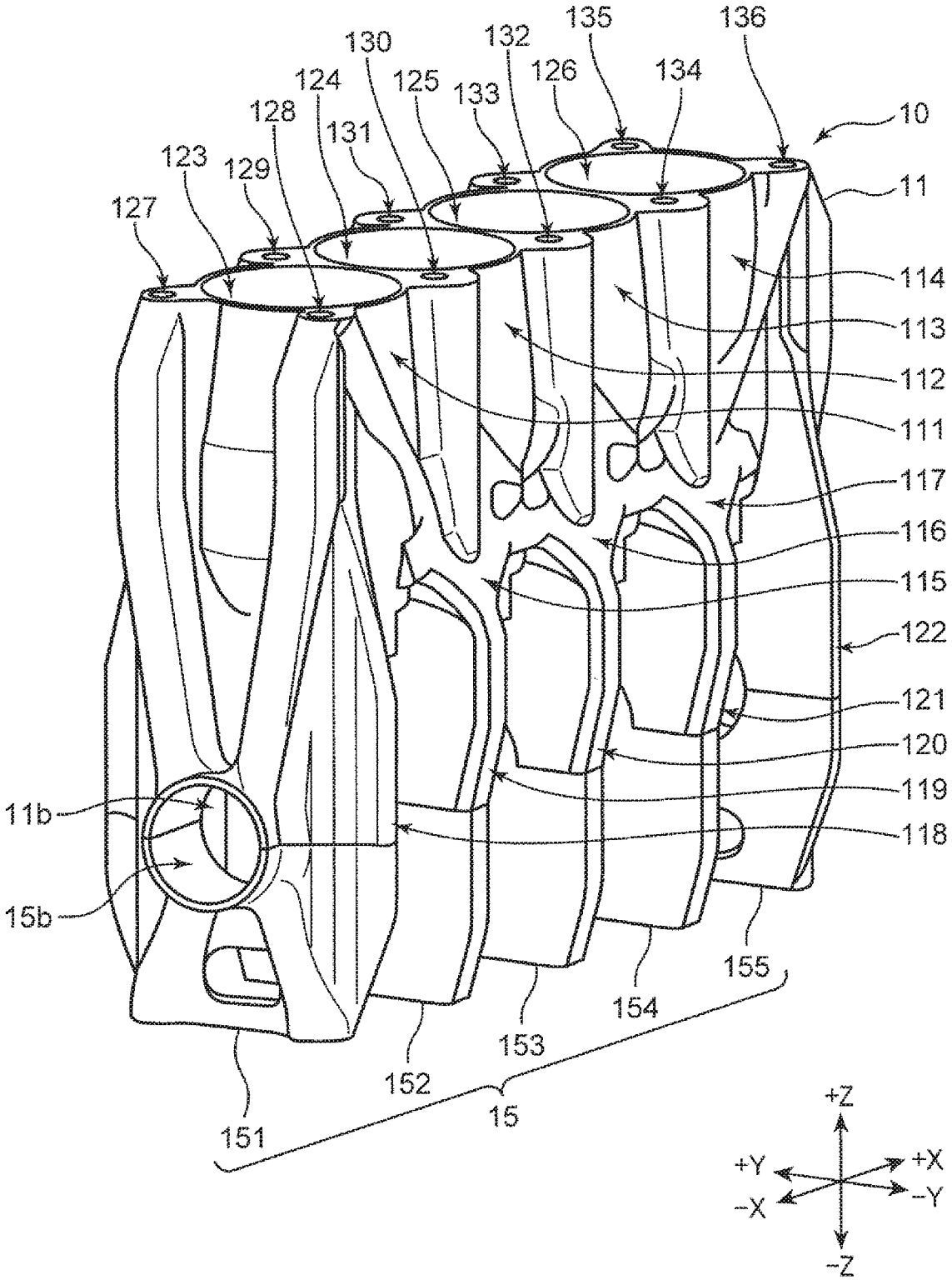
FIG. 4 is a schematic perspective view illustrating a configuration of the block core and the bearing cap.

A configuration of the block core 11 and the bearing cap 15 will be described with reference to FIG. 4. FIG. 4 is a schematic perspective view illustrating a configuration of the block core 11 and the bearing cap 15.

As illustrated in FIG. 4, the block core 11 of the cylinder block 10 includes four cylinder portions 111 to 114, three connecting portions 115 to 117, and five shaft supporting parts (output shaft supporting portions) 118 to 122. The four cylinder portions 111 to 114, the three connecting portions 115 to 117, and the five shaft supporting portions 118 to 122 of the block core 11 are integrally formed using a metal material.

The four cylinder portions 111 to 114 respectively include cylinders 123 to 126. The cylinders 123 to 126 are arranged along X direction. A plurality of head bolt holes 127 to 136 are provided to penetrate the block core 11 in Z direction. Among a plurality of the head bolt holes 127 to 136, the head bolt holes 127, 129, 131, 133, and 135 are provided in a +Y side wall of the block core 11, and the head bolt holes 128, 130, 132, 134, and 136 are provided in a −Y side wall of the block core 11.

The head bolt holes 129 to 134 are each provided in a portion between two cylinders adjacent along X direction among the cylinders 123 to 126. The head bolt holes 127, 128, 135, and 136 are provided in outer sides in X direction of the cylinders 123 and 126.

With respect to Y direction, the head bolt hole 127 and the head bolt hole 128 form a pair, the head bolt hole 129 and the head bolt hole 130 form a pair, the head bolt hole 131 and the head bolt hole 132 form a pair, the head bolt 133 and the head bolt 134 form a pair, and the head bolt 135 and the head bolt 136 form a pair.

The connecting portion 115 is provided in a −Z portion (joint portion) between the cylinder portion 111 and the cylinder portion 112 adjacent to each other along X direction. The connecting portion 116 is provided in a −Z portion (joint portion) between the cylinder part 112 and the cylinder portion 113 adjacent to each other along X direction. The connecting portion 117 is provided in a −Z portion (joint portion) between the cylinder portion 113 and the cylinder portion 114 adjacent to each other along X direction.

FIG. 4 illustrates only a −Y side wall face of the block core 11. Connecting portions are provided in a similar manner also on a +Y side wall face on the opposite side.

The shaft supporting portions 119 to 121 extend in −Z side from −Z portions of the connecting portions 115 to 117.

Meanwhile, the shaft supporting portions 118 and 122 extend in −Z side from outer portions in X direction of the cylinder portions 111 and 114. In the present embodiment, the shaft supporting portions 118 and 122 are referred to also as shaft supporting end portions. The shaft supporting end portions 118 and 122 correspond to output shaft supporting end portions.

Each of the shaft supporting portions 118 to 122 has a plate shape having a thickness in X direction smaller than a width in Y direction and a height in Z direction.

As illustrated in FIG. 4, bearing caps (cap portions) 151 to 155 are attached to −Z portions of the shaft supporting portions 118 to 122. The bearing caps 151 to 155 are collectively referred to as "bearing cap 15".

The bearing caps 151 to 155 are attached to the shaft supporting portions 118 to 122 by fastening with the head bolts 20 as described with reference to FIG. 3. A compressional stress created by fastening the head bolts 20 in the threaded holes 15*a* in the bearing cap 15 (bearing caps 151 to 155) acts on the block core 11 along Z direction.

4. Configuration of Cylinder Portions 111 and 114, Shaft Supporting End Portions 118 and 122, and Bearing Caps 151 and 155

Figure 5:
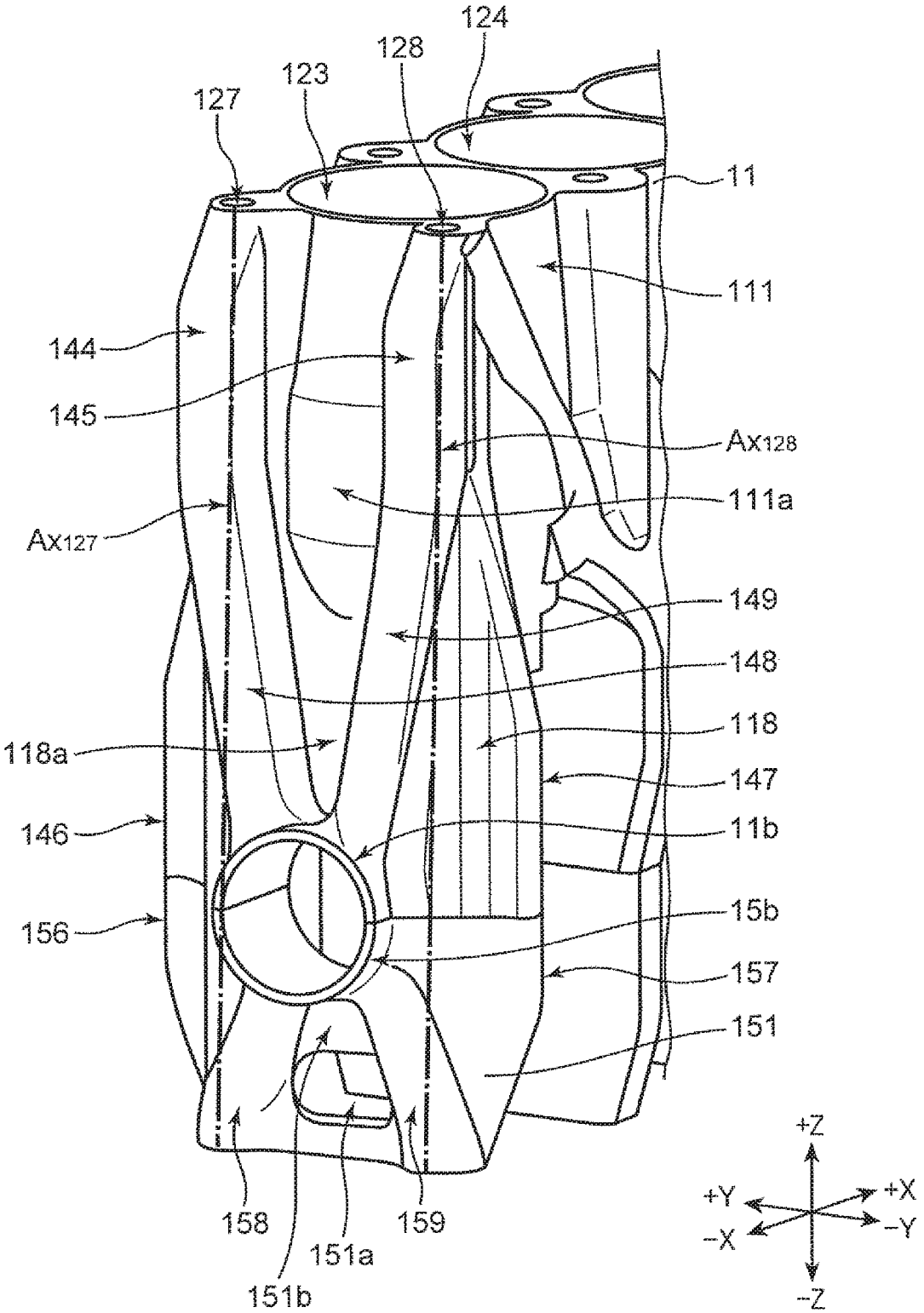
FIG. 5 is a schematic perspective view illustrating a configuration, at an end portion in X direction, of a cylinder portion, a shaft supporting portion, and the bearing cap.
Figure 6:
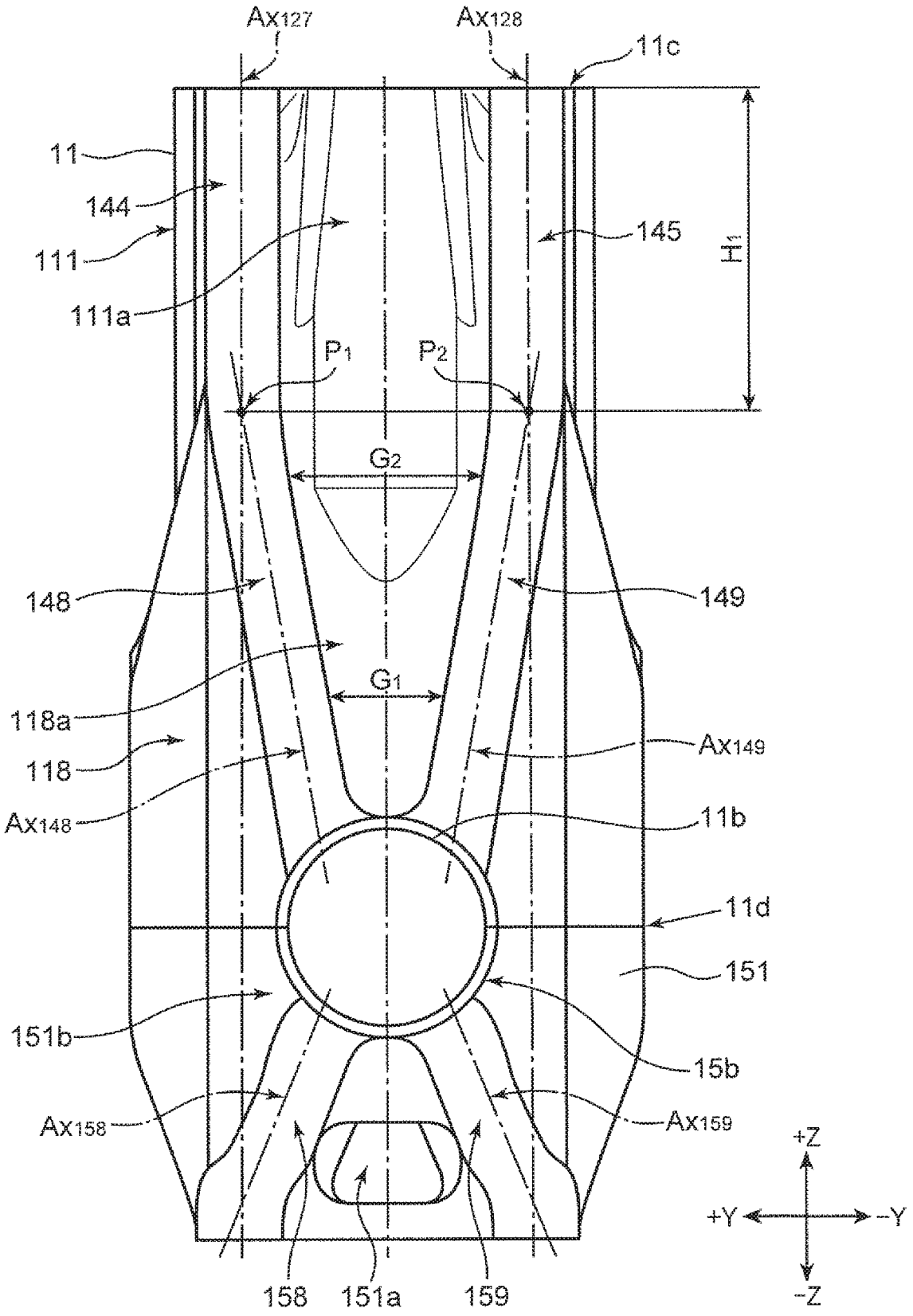
FIG. 6 is a schematic front view illustrating a configuration, at an end portion in X direction, of the cylinder portion, the shaft supporting portion, and the bearing cap.

A configuration of the shaft supporting end portions 118 and 122 and the bearing caps 151 and 155 will be described with reference to FIGS. 5 and 6. FIG. 5 is a schematic perspective view illustrating a configuration of the cylinder portion 111, the shaft supporting end portion 118, and the bearing cap 151. FIG. 6 is a schematic front view illustrating a configuration of the cylinder portions 111, the shaft supporting end portion 118, and the bearing cap 151. The cylinder portion 114, the shaft supporting end portion 122, and the bearing cap 155 are omitted in FIGS. 5 and 6, but are respectively configured similar to the cylinder portions 111, the shaft supporting end portion 118, and the bearing cap 151.

As illustrated in FIG. 5, the shaft supporting end portion 118 is provided with longitudinal ribs 146 and 147 extending respectively in +Y side and −Y side from side portions in Y direction of the shaft supporting end portion 118. The longitudinal ribs 146 and 147 each has a form of a thin plate or a fin.

The bearing cap 151 is provided with longitudinal ribs 156 and 157 extending respectively in +Y side and −Y side from side portions in Y direction of the bearing cap 151. The longitudinal ribs 156 and 157 contact the longitudinal ribs 146 and 147 by +Z portions. The longitudinal ribs 156 and 157 each has a form of a thin plate or a fin like the longitudinal ribs 146 and 147.

As illustrated in FIGS. 5 and 6, head bolt hole bases 144 and 145 are provided to a −X end wall face (outer wall face) 111*a* of the cylinder portion 111. The head bolt hole base 144 is provided to a +Y end portion, and the head bolt hole base 145 is provided to a −Y end portion.

As illustrated in FIG. 5, the head bolt hole bases 144 and 145 respectively protrude from bolt hole axis $Ax_{127}$ of the head bolt hole 127 and bolt hole axis $Ax_{128}$ of the head bolt hole 128 in −X side. The head bolt hole bases 144 and 145 each has a form of a cylindrical rib. The head bolt hole 127 is provided in the head bolt hole base 144, and the head bolt hole 128 is provided in the head bolt hole base 145.

As illustrated in FIGS. 5 and 6, an end wall reinforcing rib (first rib) 148 and an end wall reinforcing rib (second rib) 149 are provided to a −X end wall face (outer wall face) 118*a* of the shaft supporting end portion 118. The end wall reinforcing rib 148 diagonally extends in +Y and +Z side from an outer rim of the bearing portion 11*b*. The end wall reinforcing rib 149 diagonally extends in −Y and +Z side from the outer rim of the bearing portion 11*b*.

As illustrated in FIG. 5, the end wall reinforcing ribs 148 and 149 each has a form of a semi-cylindrical rib protruding in −X side. As illustrated in FIGS. 5 and 6, the end wall reinforcing rib 148 is joined to the head bolt hole base 144 by a +Z end portion, and the end wall reinforcing rib 149 is joined to the head bolt hole base 145 by a +Z end portion.

As illustrated in FIG. 6, the rib central axis $Ax_{148}$ of the end wall reinforcing rib 148 and the bolt hole axis $Ax_{127}$ of the head bolt hole base 144 intersect each other at a junction point $P_1$ located at a distance $H_1$ in −Z side from a mating face 11*c*, which contacts the cylinder head 13, of the block core 11.

Similarly, the rib central axis $Ax_{149}$ of the end wall reinforcing rib 149 intersects the bolt hole axis $Ax_{128}$ of the head bolt hole base 145 at a junction point $P_2$ located at a distance $H_1$ in −Z side from the mating face 11*e*, which contacts the cylinder head 13, of the block core 11.

The distance between the end wall reinforcing rib 148 and the end wall reinforcing rib 149 gradually increases from −Z side to +Z side. Specifically, a distance $G_2$ between the end wall reinforcing rib 148 and the end wall reinforcing rib 149 at a location further in +Z side is wider than a distance $G_1$ between the end wall reinforcing rib 148 and the end wall reinforcing rib 149 at a location further in −Z side.

As illustrated in FIG. 6, the end wall reinforcing rib 148 and the end wall reinforcing rib 149 are not joined to each other even at their lower end portions (−Z end portions).

As illustrated in FIGS. 5 and 6, an end wall reinforcing rib (third rib) 158 and an end wall reinforcing rib (fourth rib) 159 are provided to a −X end wall face (outer wall face) 151*b* of the bearing cap 151. The end wall reinforcing rib 158 diagonally extends in +Y and −Z side from an outer rim of the bearing portion 15*b*. The end wall reinforcing rib 159 diagonally extends in −Y and −Z side from the outer rim of the bearing portion 15*b*.

The end wall reinforcing ribs 158 and 159 each has a form of a semi-cylindrical rib protruding in −X side. An aperture 151*a* is provided between, in Y direction, the end wall reinforcing rib 158 and the end wall reinforcing rib 159.

As illustrated in FIG. 6, a rib central axis $Ax_{158}$ of the end wall reinforcing rib 158 and the bolt hole axis $Ax_{127}$ intersect each other at a point near a lower end portion (−Z end portion) of the bearing cap 151. Similarly, a rib central axis $Ax_{159}$ of the end wall reinforcing rib 159 and a bolt hole axis $Ax_{178}$ intersect each other at a point near a lower end portion (−Z end portion) of the bearing cap 151.

5. Compressional Stress Acting on Block Core 11 by Fastening with Head Bolts 20

Figure 7:
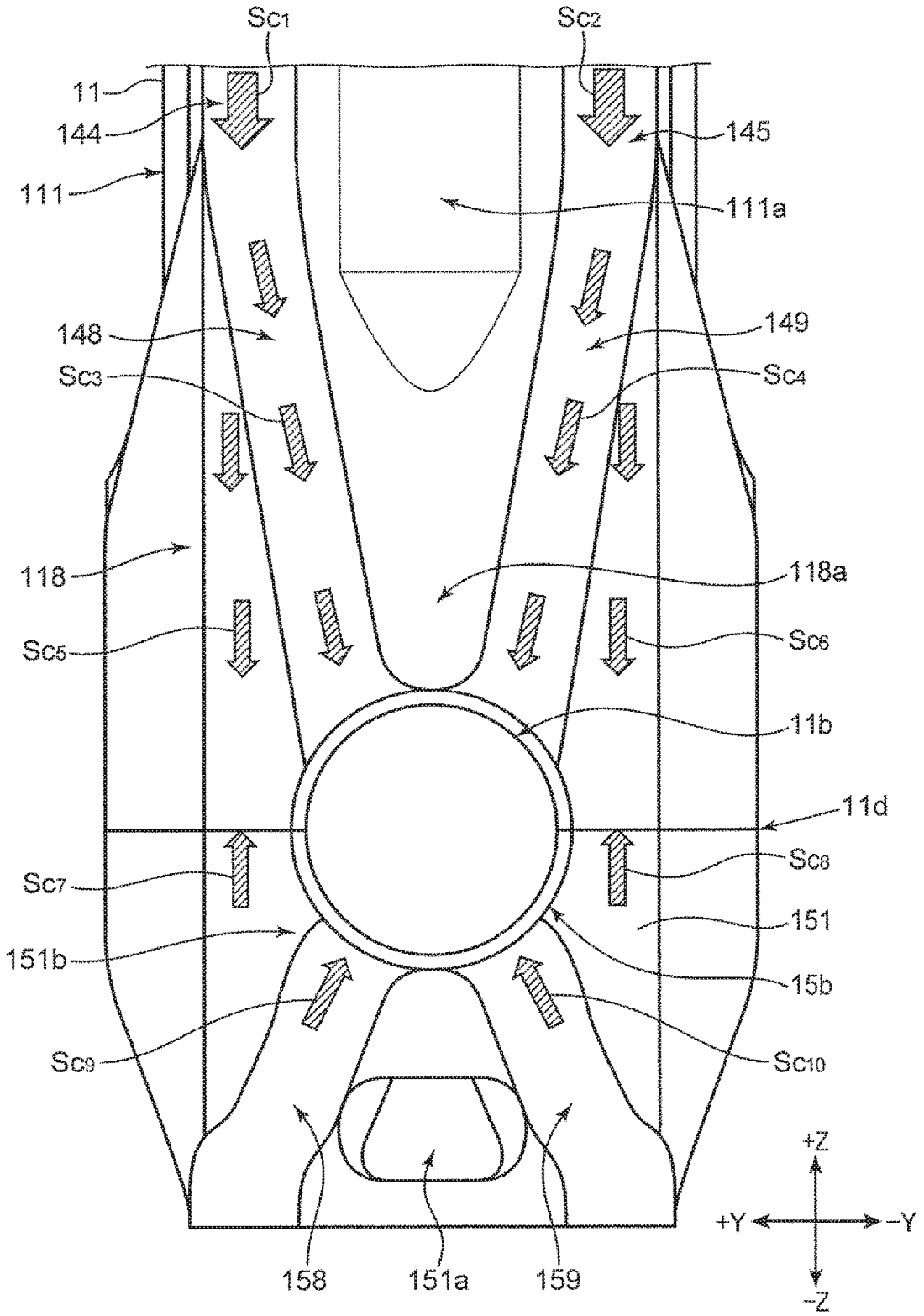
FIG. 7 is a schematic view for describing a compressional stress created by screwing the head bolts to act on the block core.

A compressional stress that acts on the block core 11 by fastening with the head bolts 20 will be described with reference to FIG. 7. FIG. 7 is a schematic view for describing compressional stresses $Sc_1$, $Sc_2$, $Sc_7$, and $Sc_8$ that act on the block core 11 by fastening with the head bolts 20.

As illustrated in FIG. 7, the compressional stresses $Sc_1$, $Sc_2$, $Sc_7$, and $Sc_8$ act on the block core 11 by fastening with the head bolts 20. High compressional stresses $Sc_1$, $Sc_2$, $Sc_7$, and $Sc_8$ act on regions where the head bolts 20 are inserted (head bolt hole bases 144 and 145) and vicinities of the regions.

In the cylinder block 10 according to the present embodiment, the end wall reinforcing ribs 148 and 149 are formed on the end wall faces 118*a* of the shaft supporting end portions 118 and 122 at end portions in X direction of the block core 11. Thus, portions of the compressional stresses $Sc_1$ and $Sc_2$ are distributed as stress components $Sc_3$ and $Sc_4$ acting along the end wall reinforcing ribs 148 and 149. The remaining portions of the compressional stresses $Sc_1$ and $Sc_2$ are stress components $Sc_5$ and $Sc_6$ that act toward −Z side.

As described above, providing the end wall reinforcing ribs 148 and 149 to the block core 11 can cause the compressional stresses $Sc_1$ and $Sc_2$, which are created by fastening with the head bolts 20 to act on the block core 11, to also act on a circumferentially inner portion of the outer rim of the bearing part portion 11*b*.

As illustrated in FIG. 7, the end wall reinforcing ribs 158 and 159 are provided to the end wall faces 151*b* of the bearing caps 151 and 155. Thus, the compressional stress acting on the block core 11 by fastening with the head bolts 20 are distributed as stress components $Sc_7$ and $Sc_8$ and stress components $Sc_9$ and $Sc_{10}$. Among these stress components, the stress components $Sc_7$ and $Sc_8$ act on the mating faces 11*d*, which contact the bearing caps 151 and 155, of the block core 11 while the stress components $Sc_9$ and $Sc_{10}$ act on a circumferentially inner portion of the bearing portion 15*b*. As described above, the distributed stress also acts on the outer rim of the bearing portion 15*b* of the bearing caps 151 and 155.

Since the bearing caps 151 and 155 are each provided with the aperture 151*a*, a transfer path of the compressional stress is controlled to run through portions other than the aperture 151*a*.

As described above, with the end wall reinforcing ribs 148 and 149 provided to the shaft supporting end portions 118 and 122, which are the end portions in X direction of the block core 11, and the end wall reinforcing ribs 158 and 159 provided to the bearing caps 151 and 155 corresponding to the shaft supporting end portions 118 and 122, the compressional stress can be created in a further circumferentially uniform manner to act on the bearing portions 11*b* and 15*b*, which support the crank shaft 16.

6. Effect

In the engine 1 according to the present embodiment, the end wall faces 118*a* of the shaft supporting end portions 118 and 122 are provided with the end wall reinforcing ribs 148 and 149 that diagonally extend toward the head bolt hole bases 144 and 145, so that the compressional stresses $Sc_1$ and $Sc_2$ that are created by fastening and act on the mating faces 11*d*, which contact the bearing caps 151 and 155, of the cylinder block 10 can be distributed to regions where the end wall reinforcing ribs 148 and 149 extend. In the engine 1 according to the present embodiment, a state of the compressional stresses $Sc_1$ and $Sc_2$, created by fastening with the head bolts 20, locally acting only on the head bolt hole bases 144 and 145 and vicinities thereof can be suppressed. Thus, the structure has a sufficient strength to endure the compressional stresses $Sc_1$ and $Sc_2$ while suppressing the increase in the area of the mating face between the block core 11 of the cylinder block 10 and the bearing cap 15.

Accordingly, the engine 1 according to the present embodiment, which has a configuration in which the cylinder head 13, the block core 11 of the cylinder block 10, and the bearing cap 15 are fastened together with the head bolts 20, has a sufficient strength to endure the compressional stress acting on the block core 11 while suppressing the increase in the area of the mating face (mating face 11*c*) between the block core 11 of the cylinder block 10 and the bearing cap 15.

Furthermore, in the engine 1 according to the present embodiment, the end wall reinforcing ribs 148 and 149 are joined to the head bolt hole bases 144 and 145 at the points located below the mating face 11*c*, which contacts the cylinder head 13, of the block core 11 of the cylinder block 10 by the distance $H_1$ (at the points in −Z side), and this suppresses the state of the compressional stresses $Sc_1$ and $Sc_2$ created by fastening locally acting on the mating face 11*c*, which contacts the cylinder head 13, of the block core 11. Thus, the engine 1 has high sealability at the mating face 11*c*, which contacts the cylinder head 13, of the block core 11.

Furthermore, in the engine 1 according to the present embodiment, the distance ($G_1$ and $G_2$) between the end wall reinforcing rib 148 and the end wall reinforcing rib 149 provided to the shaft supporting end portions 118 and 122 gradually becomes wider from −Z side toward +Z side, so that the compressional stresses $Sc_1$ and $Sc_2$ created by fastening are further uniformly distributed.

Furthermore, in the engine 1 according to the present embodiment, the end wall reinforcing rib 148 and the end wall reinforcing rib 149 are in line-symmetric (bilaterally symmetric) relationship about a central axis $Ax_{123}$ of the cylinder 123 in a front view viewed along X direction as illustrated in FIG. 6, so that the compressional stresses $Sc_1$ and $Sc_2$ created by fastening can be further uniformly distributed along a right-and-left direction.

Furthermore, in the engine 1 according to the present embodiment, the diagonally extending end wall reinforcing ribs 158 and 159 are provided to the end wall faces 151*b* of the bearing caps 151 and 155, so that the compressional stress created by fastening is distributed to regions where the end wall reinforcing ribs 158 and 159 extend on the bearing caps 151 and 155. Thus, the engine 1 according to the present embodiment can more reliably suppress the state of the compressional stress, created by fastening, locally acting on the mating face between the bearing cap 15 and the block core 11 (mating face 11*d*, which contacts the bearing cap 15, of the block core 11).

Furthermore, the engine 1 according to the present embodiment includes the cylinder block outer wall 12 formed using a resin material, so that the weight of the engine 1 can further be reduced as compared to a case of using a metal material for the whole cylinder block 10. While using the cylinder block outer wall 12 made of a resin material to reduce weight with the configuration in which the cylinder head 13, the cylinder block 10, and the bearing cap 15 are fastened together, a high strength can be obtained, as described above, by forming the end wall reinforcing ribs 148 and 149 on the end wall faces (outer wall faces) 118*a* of the shaft supporting end portions 118 and 122 and the end wall reinforcing ribs 158 and 159 on the end wall faces 151*b* of the bearing caps 151 and 155.

As described above, the engine 1 according to the present embodiment, which has a configuration in which the cylinder head 13, the cylinder block 10, and the bearing cap 15 are fastened together, has a sufficient strength to endure the compressional stress acting on the block core 11 while suppressing the increase in the area of the mating face 11*d*, which contacts the bearing cap 15, of the block core 11. Furthermore, in the engine 1, the shaft supporting portions 118 to 122 of the block core 11 and the bearing caps 151 to 155 can reliably support the crank shaft 16 while suppressing the increase in the area of the mating face 11*d*.

[Exemplary Modification]

In the engine 1 according to the above embodiment, the end wall face 118*a* of each of the shaft supporting end portions 118 and 122 of the block core 11 is provided with two end wall reinforcing ribs 148 and 149. However, the present invention is not limited to such a configuration. For example, one of the end wall reinforcing ribs 148 and 149 may be omitted. The effect of reinforcing the end wall can also be obtained even in such a case.

In the engine 1 according to the above embodiment, the shaft supporting portions 119 to 121 disposed in the inner side in X direction have no rib to reinforce the walls. However, a reinforcing rib may be provided to the shaft supporting portions 119 to 121 as long as interference between the rib and a portion, such as the counter weight 16*d* of the crank shaft 16, is avoided.

In the above embodiment, the end wall reinforcing rib 148 and the end wall reinforcing rib 149 are not joined to each other. However, the present invention is not limited to such a configuration. For example, the end wall reinforcing ribs may be joined to each other or intersect each other.

In the engine 1 according to the above embodiment, the end wall face 151*b* of each of the bearing caps 151 and 155 is provided with the end wall reinforcing ribs 158 and 159. However, the present invention is not limited to such a configuration. For example, the end wall faces of the bearing caps may have no end wall reinforcing rib or only one of the end wall faces may be provided with the end wall reinforcing rib. Providing three or more ribs to the end wall face is not out of the scope of the present invention.

In the engine 1 according to the above embodiment, the end wall reinforcing ribs 148 and 149 and the end wall reinforcing ribs 158 and 159 each has a form of a semicircular-column. However, the present invention is not limited to such a configuration. For example, a rib having a polygonal cross section or a rib having a shape of a fin may be used.

In the engine 1 according to the above embodiment, the end wall reinforcing rib 148 is joined to the head bolt hole base 144 by the +Z portion and the end wall reinforcing rib 149 is joined to the head bolt hole base 145 by the +Z portion. However, the present invention is not limited to such a configuration. The end wall reinforcing rib 148 is not necessarily joined to the head bolt hole base 144, and the end wall reinforcing rib 149 is not necessarily joined to the head bolt hole base 145.

The width and the height of the end wall reinforcing rib need not be constant along the longitudinal direction. Such a rib that gradually increases its width and decreases its height from −Z side toward +Z side or a rib that gradually decreases its width and increases its height from −Z side toward +Z side may be used.

The end wall reinforcing rib is not necessarily straight but may be curved on the end wall face.

In the engine 1 according to the above embodiment, the lower end portions of the bearing caps 151 to 155 are free ends that are not joined to each other. However, the present invention is not limited to such a configuration. For example, the lower end portions of the bearing caps may be connected to each other by a beam member.

Furthermore, in the above embodiment, the head bolts 20 are inserted, from above the cylinder head 13, in the cylinder head 13 and the block core 11 to be screwed in the female threads of the threaded holes 15*a* provided in the bearing cap 15. However, the present invention is not limited to such a configuration. For example, the head bolts may be inserted, from below the bearing cap, in the bearing cap and the block core to be screwed in the female threads of the threaded holes provided in the cylinder head.

In the engine 1 according to the above embodiment, whether a head gasket is interposed between the cylinder head 13 and the cylinder block 10 is not particularly mentioned. However, a head gasket may be interposed between the cylinder head 13 and the cylinder block 10.

In the above embodiment described above, the engine 1 is an exemplary four-cylinder gasoline engine. However, the present invention is not limited to such a configuration. For example, the engine may have a single cylinder, two cylinders, three cylinders, or five or more cylinders. The engine may be a diesel engine.

SUMMARY

An engine according to one aspect of the present invention includes an output shaft of the engine, a cylinder block including a cylinder portion in which a cylinder is formed, and a plurality of output shaft supporting portions each having a portion that supports the output shaft at a location closer to the output shaft with respect to the cylinder portion, the cylinder block being disposed in an upper side of the output shaft in a cylinder axial direction, a cylinder head attached to an upper portion of the cylinder block in the cylinder axial direction, cap portions each attached to a lower portion of one of the plurality output shaft supporting parts in the cylinder axial direction and having a portion that supports the output shaft, and head bolts for fastening together the cylinder block, the cylinder head, and the cap portions. The cylinder block has two head bolt holes each provided at a location, in an output shaft axial direction in which the output shaft extends, that corresponds to one of the plurality of output shaft supporting portions and penetrating, in the cylinder axial direction, a portion in a radially outer side of the output shaft as viewed along the output shaft axial direction, the head bolts being inserted in the head bolt holes, and when at least one of the plurality of output shaft supporting portions is viewed along the output shaft axial direction, an outer wall face of the at least one output shaft supporting portion includes a first rib diagonally extending from a supporting portion of the output shaft toward one of the two head bolt holes.

In the engine according to the above aspect, the outer wall face of the at least one output shaft supporting portion is provided with the first rib diagonally extending toward the head bolt hole, so that the compressional stress that is created by fastening and acts on the mating face, which contact the cap portion, of the cylinder block can be distributed to a region where the first rib extends. In the engine according to the above aspect, the state of the compressional stress, created by fastening, locally acting only on a vicinity of the head bolt hole can be suppressed, so that the structure has a sufficient strength to endure the compressional stress while suppressing the increase in the area of the mating face between the cylinder block and the cap portion.

Accordingly, the engine according to the above aspect having a configuration in which the cylinder head, the cylinder block, and the cap portion are fastened together has a sufficient strength to endure the compressional stress acting on the cylinder block while suppressing the increase in the area of the mating face between the cylinder block and the cap portion.

In the above aspect, the vertical direction is defined as a reference direction of reciprocation of the piston in the cylinder. The same can be applied herein.

In the engine according to the above aspect, when the at least one output shaft supporting portion is viewed along the output shaft axial direction, the outer wall face of the at least one output shaft supporting portion may include two head bolt hole bases each having a form of a circular-column, each of the two head bolt holes may be provided in an inner portion of the head bolt hole base, and the first rib may be joined to the head bolt hole base at a point located lower than a mating face, which contacts the cylinder head, of the cylinder block in the cylinder axial direction.

In the engine having such a configuration, the first rib is joined to the head bolt hole base at the point located lower than the mating face between the cylinder block and the cylinder head, so that the state of the compressional stress, created by fastening, locally acting on the mating face between the cylinder head and the cylinder block can be suppressed. Thus, the engine having such a configuration has high sealability at the mating face between the cylinder block and the cylinder head.

In the engine according to the above aspect, when the at least one output shaft supporting portion is viewed along the output shaft axial direction, the outer wall face of the at least one output shaft supporting portion may include a second rib diagonally extending from the supporting portion of the output shaft toward another one of the two head bolt holes.

In the engine having such a configuration, the outer wall face of the output shaft supporting portion is provided with the second rib diagonally extending toward another head bolt hole, so that the compressional stress that is created by fastening and acts on the mating face between the cylinder block and the cap portions can be distributed to a region where the second rib extends. The engine according to the above aspect can more reliably suppress the state of the compressional stress, created by fastening, locally acting only on the vicinity of the head bolt hole.

In the engine according to the above aspect, when the output shaft supporting portion is viewed along the output shaft axial direction, a distance between the first rib and the second rib may gradually increase from a lower side toward an upper side along the cylinder axial direction.

In the engine having such a configuration, the distance between the first rib and the second rib gradually increases from a lower side toward the upper side, so that the compressional stress created by fastening is further uniformly distributed.

In the engine according to the above aspect, when the at least one output shaft supporting portion is viewed along the output shaft axial direction, the first rib and the second rib may be in a line-symmetric relationship about a central axis of the cylinder.

In the engine having such a configuration, the first rib and the second rib are provided to be in a line-symmetric (bilaterally symmetric) relationship about the central axis of the cylinder as viewed along the output shaft axial direction (front view), so that the compressional stress created by fastening can further uniformly be distributed along the right-and-left direction.

In the engine according to the above aspect, the at least one output shaft supporting portion among the plurality of the output shaft supporting portions may be an output shaft supporting end portion disposed at one or both ends in the output shaft axial direction.

In the engine having such a configuration, the output shaft supporting portion having the first rib serves as the output shaft supporting end portion, so that interference between the first rib and a portion of the output shaft (for example, a counter weight) can be avoided.

In the engine according to the above aspect, the cap portion may include, as viewed along the output shaft axial direction, two threaded holes penetrating, in the cylinder axial direction, the portions in the radially outer sides of the output shaft, the head bolt being screwed in the threaded hole, and when the cap portion is viewed along the output shaft axial direction, an outer wall face of the cap portion may include a third rib diagonally extending from the supporting portion of the output shaft toward one of the two threaded holes.

In the engine having such a configuration, the outer wall face of the cap portion is provided with the diagonally extending third rib, so that the compressional stress created by fastening is distributed to a region where the third rib extends on the cap portion. Thus, the engine according to the above aspect can more reliably suppress the state of the compressional stress, created by fastening, locally acting on the mating face between the cap portion and the cylinder block.

In the engine according to the above aspect, when the cap portion is viewed along the output shaft axial direction, the outer wall face of the cap portion may include a fourth rib diagonally extending from the supporting portion of the output shaft toward another one of the two threaded holes.

In the engine having such a configuration, the outer wall face of the cap portion is provided with the fourth rib that diagonally extends toward a portion where another threaded hole is provided, so that the compressional stress created by fastening can be distributed to a region where the fourth rib extends. The engine according to the above aspect can more reliably suppress the state of the compressional stress, created by fastening, locally acting only on the vicinity of the threaded hole in the cap portion.

In the engine according to the above aspect, the cylinder block may further include a cylinder block outer wall surrounding the cylinder portion, the output shaft supporting portion, and the cap portions, the cylinder portion and the output shaft supporting portion may be integrally formed using a metal material, and the cylinder block outer wall may be formed using a resin material.

The engine having such a configuration includes the cylinder block outer wall formed using a resin material, so that the weight of the engine can further be reduced than using a metal material for the whole cylinder block. While using the cylinder block outer wall made of a resin material to reduce weight with the configuration in which the cylinder head, the cylinder block, and the cap portion are fastened together, a high strength can be obtained by forming the first rib on the outer wall face of the output shaft supporting portion as described above.

As described above, the engine having a configuration in which the cylinder head, the cylinder block, and the cap portion are fastened together has a sufficient strength to endure the compressional stress acting on the cylinder block while suppressing the increase in the area of the mating face between the cylinder block and the cap portion.

The invention claimed is:

1. An engine comprising:

an output shaft of the engine;

a cylinder block including a cylinder portion in which a cylinder is formed, and a plurality of output shaft supporting portions each having a portion that supports the output shaft at a location closer to the output shaft with respect to the cylinder portion, the cylinder block being disposed in an upper side of the output shaft in a cylinder axial direction;

a cylinder head attached to an upper portion of the cylinder block in the cylinder axial direction;

cap portions each attached to a lower portion of one of the plurality output shaft supporting portions in the cylinder axial direction and having a portion that supports the output shaft; and head bolts for fastening together the cylinder block, the cylinder head, and the cap portions, wherein the cylinder block has two head bolt holes each provided at a location, in an output shaft axial direction in which the output shaft extends, that corresponds to one of the plurality of output shaft supporting portions and penetrating, in the cylinder axial direction, a portion in a radially outer side of the output shaft as viewed along the output shaft axial direction, the head bolts being inserted in the head bolt holes, and when at least one of the plurality of output shaft supporting portions is viewed along the output shaft axial direction, an outer wall face of the at least one output shaft supporting portion includes a first rib diagonally extending from a supporting portion of the output shaft toward one of the two head bolt holes, and the cap portion includes, as viewed along the output shaft axial direction, two threaded holes penetrating, in the cylinder axial direction, the portions in the radially outer sides of the output shaft, the head bolt being screwed in the threaded hole, and when the cap portion is viewed along the output shaft axial direction, an outer wall face of the cap portion includes a third rib diagonally extending from the supporting portion of the output shaft toward one of the two threaded holes.

2. The engine according to claim 1, wherein when the at least one output shaft supporting portion is viewed along the output shaft axial direction, the outer wall face of the at least one output shaft supporting portion includes two head bolt hole bases each having a form of a circular-column, each of the two head bolt holes is provided in an inner portion of the head bolt hole base, and the first rib is joined to the head bolt hole base at a point located lower than a mating face, which contacts the cylinder head, of the cylinder block in the cylinder axial direction.

3. The engine according to claim 2, wherein when the at least one output shaft supporting portion is viewed along the output shaft axial direction, the outer wall face of the at least one output shaft supporting portion includes a second rib diagonally extending from the supporting portion of the output shaft toward another one of the two head bolt holes.

4. The engine according to claim 3, wherein when the output shaft supporting portion is viewed along the output shaft axial direction, a distance between the first rib and the second rib gradually increases from a lower side toward an upper side along the cylinder axial direction.

5. The engine according to claim 4, wherein when the at least one output shaft supporting portion is viewed along the output shaft axial direction, the first rib and the second rib are in a line-symmetric relationship about a central axis of the cylinder.

6. The engine according to claim 3, wherein when the at least one output shaft supporting portion is viewed along the output shaft axial direction, the first rib and the second rib are in a line-symmetric relationship about a central axis of the cylinder.

7. The engine according to claim 1, wherein the at least one output shaft supporting portion among the plurality of the output shaft supporting portions is an output shaft supporting end portion disposed at one or both ends in the output shaft axial direction.

8. The engine according to claim 1, wherein when the cap portion is viewed along the output shaft axial direction, the outer wall face of the cap portion includes a fourth rib diagonally extending from the supporting portion of the output shaft toward another one of the two threaded holes.

9. The engine according to claim 1, wherein the cylinder block further includes a cylinder block outer wall surrounding the cylinder portion, the output shaft supporting portion, and the cap portions, the cylinder portion and the output shaft supporting portion are integrally formed using a metal material, and the cylinder block outer wall is formed using a resin material.

10. The engine according to claim 1, wherein when the at least one output shaft supporting portion is viewed along the output shaft axial direction, the outer wall face of the at least one output shaft supporting portion includes a second rib diagonally extending from the supporting portion of the output shaft toward another one of the two head bolt holes.

11. The engine according to claim 10, wherein when the output shaft supporting portion is viewed along the output shaft axial direction, a distance between the first rib and the second rib gradually increases from a lower side toward an upper side along the cylinder axial direction.

12. The engine according to claim 11, wherein when the at least one output shaft supporting portion is viewed along the output shaft axial direction, the first rib and the second rib are in a line-symmetric relationship about a central axis of the cylinder.

13. The engine according to claim 10, wherein when the at least one output shaft supporting portion is viewed along the output shaft axial direction, the first rib and the second rib are in a line-symmetric relationship about a central axis of the cylinder.

14. The engine according to claim 1, wherein the third rib extends, on the outer wall face of the cap portion in the output shaft axial direction, in a direction oblique to an intake and exhaust direction of the engine and the cylinder axial direction from an outer rim of the supporting portion of the output shaft.

15. The engine according to claim 14, wherein the third rib comprises a semi-cylindrical rib protruding in the output shaft axial direction.

16. The engine according to claim 14, wherein when the cap portion is viewed along the output shaft axial direction, the outer wall face of the cap portion includes a fourth rib diagonally extending from the supporting portion of the output shaft toward another one of the two threaded holes, and an aperture is provided between the third rib and the fourth rib in the intake and exhaust direction of the engine.

17. The engine according to claim 16, wherein a rib central axis of the fourth rib and an axis of the head bolt hole intersect each other at a point near a lower end portion of the cap portion in the cylinder axial direction.

18. The engine according to claim 14, wherein a rib central axis of the third rib and an axis of the head bolt hole intersect each other at a point near a lower end portion of the cap portion in the cylinder axial direction.

* * * * *